US012798809B2

(12) United States Patent
Anderlini

(10) Patent No.: US 12,798,809 B2
(45) Date of Patent: Nov. 17, 2026

(54) METHOD AND ASSEMBLY GROUP FOR MANUFACTURING TRAYS

(71) Applicant: BIOPAP S.R.L., Settimo Milanese (IT)

(72) Inventor: Michelangelo Anderlini, Settimo Milanese (IT)

(73) Assignee: BIOPAP S.R.L., Settimo Milanese (IT)

( * ) Notice: Subject to any disclaimer, the term of this patent is extended or adjusted under 35 U.S.C. 154(b) by 0 days.

(21) Appl. No.: 18/913,286

(22) Filed: Oct. 11, 2024

(65) Prior Publication Data

US 2025/0121968 A1 Apr. 17, 2025

(30) Foreign Application Priority Data

Oct. 13, 2023 (IT) ..... 102023000021390

(51) Int. Cl.
*B65B 5/08* (2006.01)
*B65B 5/02* (2006.01)
*B65B 7/28* (2006.01)

(52) U.S. Cl.
CPC ..... *B65B 5/08* (2013.01); *B65B 5/02* (2013.01); *B65B 7/2878* (2013.01)

(58) Field of Classification Search
CPC ..... A47J 39/006; A47J 47/14; A47J 47/02; B65B 5/02; B65B 5/08; B65B 7/2878; B65D 81/2015; B65D 1/36; B65D 21/0206; B65D 21/0233; B65D 21/0234; B65D 43/02; B65D 25/108; B65D 71/70; B65D 77/2024; B65D 81/3834; A47G 19/02; A47G 23/006; A47G 23/0633
See application file for complete search history.

(56) References Cited

U.S. PATENT DOCUMENTS 1,336,776 A * 4/1920 Drinkwater ..... B65D 81/3834 126/261
2,210,521 A 8/1940 Bemis
2,656,946 A * 10/1953 Clarke ..... A47J 47/14 220/592.2
3,025,948 A * 3/1962 Appelt ..... A47J 47/14 206/517
3,069,043 A * 12/1962 Bishop ..... B65D 81/3438 220/592.28

(Continued)

FOREIGN PATENT DOCUMENTS

CN 211933824 U * 11/2020
CN 115486675 A 12/2022

(Continued)

OTHER PUBLICATIONS

Search Report received in Application No. 102023000021390 dated Apr. 10, 2024.

*Primary Examiner* — Shelley M Self
*Assistant Examiner* — David G Shutty
(74) *Attorney, Agent, or Firm* — Meunier Carlin & Curfman LLC

(57) ABSTRACT

Method and assembly group for manufacturing a meal tray; the assembly group having a base, a container nest holder and a container nest which are coupled in a releasable way to each other; said assembly group being configured to house a plurality of containers; each tray being sealed by thermally heating a film or a rigid lid on each container housed in the assembly group.

6 Claims, 6 Drawing Sheets

(56) References Cited

U.S. PATENT DOCUMENTS 3,122,265 A * 2/1964 Innis ..... B65D 81/3834 220/23.6
3,501,044 A * 3/1970 Stone ..... A47G 23/06 D7/553.3
3,608,770 A * 9/1971 Naimoli ..... A47J 39/006 220/592.2
3,877,603 A * 4/1975 Holz ..... A47G 23/06 D7/553.5
3,904,778 A * 9/1975 Shevlin ..... A47J 27/004 426/523
4,052,589 A 10/1977 Wyatt
4,232,789 A * 11/1980 Springer ..... F16B 12/32 211/126.15
4,279,354 A * 7/1981 Conti ..... B65D 1/36 220/555
4,323,110 A * 4/1982 Rubbright ..... A47J 39/006 219/400
4,491,233 A * 1/1985 Johnson ..... A47J 39/006 206/509
4,776,485 A * 10/1988 Brennan ..... A47J 39/006 206/564
5,116,240 A * 5/1992 Wischhusen ..... B65D 81/3834 206/499
5,368,183 A * 11/1994 Singer ..... A47G 23/06 220/574.3
5,540,334 A 7/1996 Haas et al.
5,912,033 A * 6/1999 Ferguson ..... B65D 25/02 426/119
6,146,673 A * 11/2000 Ferguson ..... B65D 25/108 220/660
6,164,044 A * 12/2000 Porfano ..... A61M 5/344 53/489
6,376,803 B1 * 4/2002 Klinger ..... A47J 39/006 219/403
7,900,423 B2 3/2011 von Seggern
8,286,791 B2 * 10/2012 Finke ..... A61M 5/008 206/439
9,718,583 B2 * 8/2017 Nicoletti ..... B65D 65/02
10,182,681 B1 * 1/2019 Hart ..... A23G 1/0076
10,874,473 B2 * 12/2020 Togashi ..... B65D 81/20
10,918,784 B2 * 2/2021 Yoshida ..... A61M 5/002
11,046,475 B2 * 6/2021 Vandewall ..... B65D 5/6647
11,161,671 B2 * 11/2021 Yoshida ..... A61M 5/008
11,547,231 B1 * 1/2023 Howard, II ..... A47G 23/0633
2017/0348476 A1 * 12/2017 Thompson ..... B01L 3/50853
2021/0214135 A1 * 7/2021 Coates ..... B29C 66/131
2024/0383658 A1 * 11/2024 Li ..... A61B 5/150305

FOREIGN PATENT DOCUMENTS

DE 102011018711 A1 10/2012
EP 4245674 A1 9/2023
IT 201900001087 A1 7/2020
JP 2011135821 A 7/2011
KR 20170090189 A * 8/2017 ..... A47G 23/0641

* cited by examiner

METHOD AND ASSEMBLY GROUP FOR MANUFACTURING TRAYS

CROSS-REFERENCE TO RELATED PATENT APPLICATIONS

This patent application claims priority from Italian patent application no. 102023000021390 filed on Oct. 13, 2023, the entire disclosure of which is incorporated herein by reference.

FIELD OF THE ART

This Patent Application for an invention relates to a method and an assembly group for manufacturing trays, in particular meal trays.

More specifically, the present invention relates to the manufacturing of meal trays comprising containers made of cellulose-based material, substantially paper, preferably compostable material.

PRIOR ART

It is known to compose meal trays, for example to supply canteens. Meal trays of the known type comprise a tray, i.e. a generally flat support structure, and a plurality of containers resting on the tray. Each of which houses, in use, a foodstuff.

DISCLOSURE OF THE INVENTION

Generally, in order to make a meal tray of the known type, the containers are filled and sealed individually. Once sealed, the containers are assembled on top of the tray, which in turn can be further sealed.

The composition of known-type meal trays is difficult to be automated, as (according to known-type solutions) the arrangement and size of the containers is constrained by standard sizes of containers and trays, which are difficult to be adapted to different requirements. Let us consider, on the other hand, the need by canteen services to vary the type of food frequently, e.g. throughout a week, to ensure a varied and balanced diet and, consequently, the need to use different formats and combinations of containers and/or trays.

As an alternative to what described above, it is known to compose a meal tray, from time to time, with customised solutions that are difficult to replicate for large numbers of people to be served.

The aim of the present invention is to provide a method and an assembly group that allows to easily vary the type of meal tray and to substantially automate the manufacturing of a meal tray along a production line, so that large numbers of meal trays can be produced in a short period of time.

The aim of the present invention is to provide a method and an assembly group for manufacturing meal trays made of cellulose-based material, substantially paper and preferably compostable material. Advantageously, the meal trays are made of compostable material marketed under the BIOPAP® brand name.

According to the present invention, a method is provided for manufacturing trays, in particular meal trays, as mentioned in the appended claims.

According to the present invention, an assembly group is provided for manufacturing trays, in particular meal trays, as mentioned in the appended claims.

BRIEF DESCRIPTION OF THE DRAWINGS

The invention will be now described with reference to the enclosed drawings, which show a non-limiting embodiment thereof, wherein.

PREFERRED EMBODIMENT OF THE INVENTION

Figure 1:
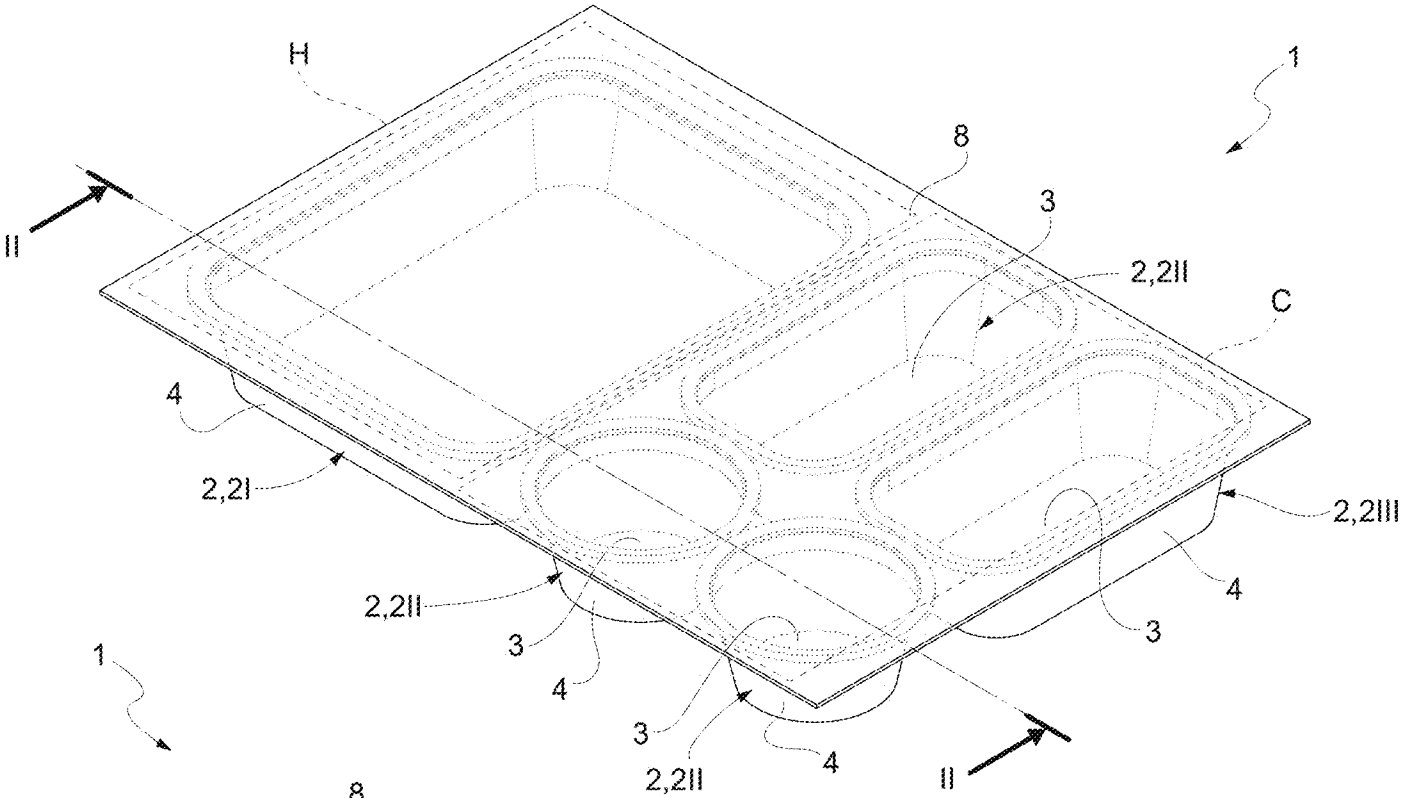
FIG. 1 schematically shows an example of a meal tray according to the present invention.
Figure 2:
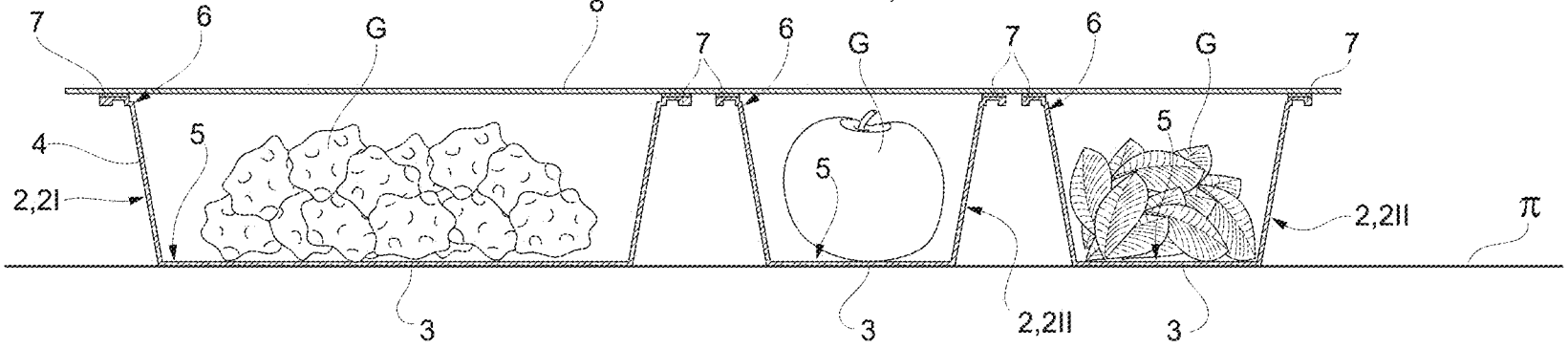
FIG. 2 is a schematic section along the plane III-II of FIG. 1.

The method and assembly group according to the present invention are configured to manufacture a meal tray 1 (FIG. 1), in particular a meal tray 1 of the type described in Patent EP 3 278 972 B1, the teachings of which are to be considered incorporated herein for brevity. In this discussion, the terms front, rear, upper, lower, right, left, and the like are used with reference to the normal use of a tray 1 in relation to a horizontal plane Π.

In particular, meal 1 tray 1 comprises a plurality of containers 2. Preferably a meal tray 1 made of In particular, each meal container 2 is made, preferably, of cellulose-based material, substantially of paper and preferably of compostable material, in particular it is made of compostable material marketed under the BIOPAP® brand name. In order to be closed, containers 2 must be thermally heated with a sealing element 8, such as a film or a rigid lid. As will be better explained hereinafter, in order to be thermally heated, containers 2 are subjected, in use, to high pressures and temperatures applied by a mould 14.

Each container 2 has a cup shaped body of substantially parallelepiped shape comprising a bottom 3, which is configured to be placed, in use, on a horizontal plane n, and lateral walls 4. Bottom 3 and lateral walls 4 delimit an inner cavity 5 that faces outwards through an upper opening 6. Each container 2 further comprises a flange 7 which protrudes radially outside from lateral walls 4 and surrounds upper opening 6. Flange 7 is configured to fasten, as known and schematically shown, with a sealing element 8, as will be better shown hereinafter.

Each container 2 can be selected from a group of containers 2 differing in shape and size. Hereinafter and in the figures, the different containers 2 are identified with different Roman numerals. In the example shown in FIG. 1, meal tray 1 comprises three different containers 2 denoted by numbers 21, 2II and 2III.

Meal tray 1 further comprises a sealing element 8 that seals, before the first opening, each container 2 and joins all meal containers 2, keeping them integral to each other to form a single unit.

Sealing element 8 can be, for example, a film or a rigid lid made of material that can be thermally heated.

Each container 2 can contain either a cold or a hot product G. Preferably, the tray 1 area is divided into a hot zone H and a cold zone C. Containers 2 are distributed in such a way that containers 2 intended to contain hot products G are arranged within the hot zone H and, similarly, containers 2 intended to contain cold products G are arranged within the cold zone C. Advantageously, the hot zone H and cold zone C are spaced apart by sufficient space to insert shielding elements S, such as partition walls, between containers 2 in the hot zone H and containers 2 in the cold zone C. Thus, according to the example shown in FIG. 3, it is possible to store a plurality of meal trays 1 in special trolleys F that keep the hot zone H separate from the cold zone C. This type of solution is particularly advantageous for canteen services, as it allows an entire meal to be served easily, hygienically and quickly by handling a single meal tray 1 in an orderly manner.

Meal tray 1 can be manufactured automatically, as will be further explained hereinafter, by means of an assembly group 9 according to the present invention.

Figure 4:
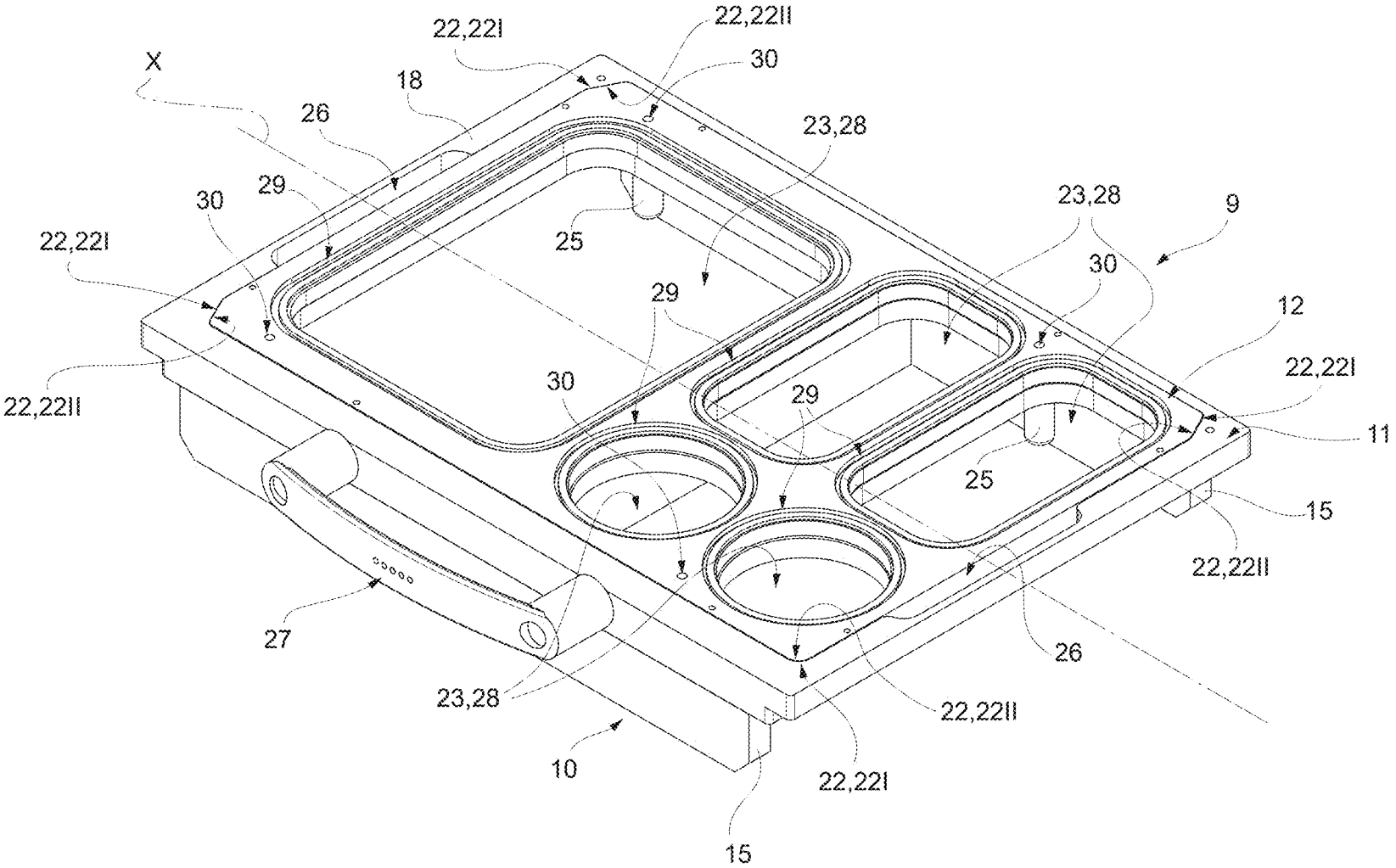
FIG. 4 is a perspective view of an assembly group according to the present invention.

FIG. 4 shows, for exemplary and non-limiting purposes, an assembly group 9 according to the present invention. Assembly group 9 comprises a base 10, a container nest holder 11 and a container nest 12. Base 10, container nest holder 11 and container nest 12 may differ from the examples shown and may be selected according to the type of meal tray 1 to be manufactured. Base 10 is selected from a group of bases 10 differing from each other in shape and/or size. Container nest holder 11 is selected from a group of container nest holders 11 differing from each other in shape and/or size. Container nest 12 is selected from a group of container nests 12 differing from each other in shape and/or size. Base 10, container nest holder 11, and container nest 12 of an assembly group 9 are coordinated with each other so that they can be mounted together.

Figure 7:
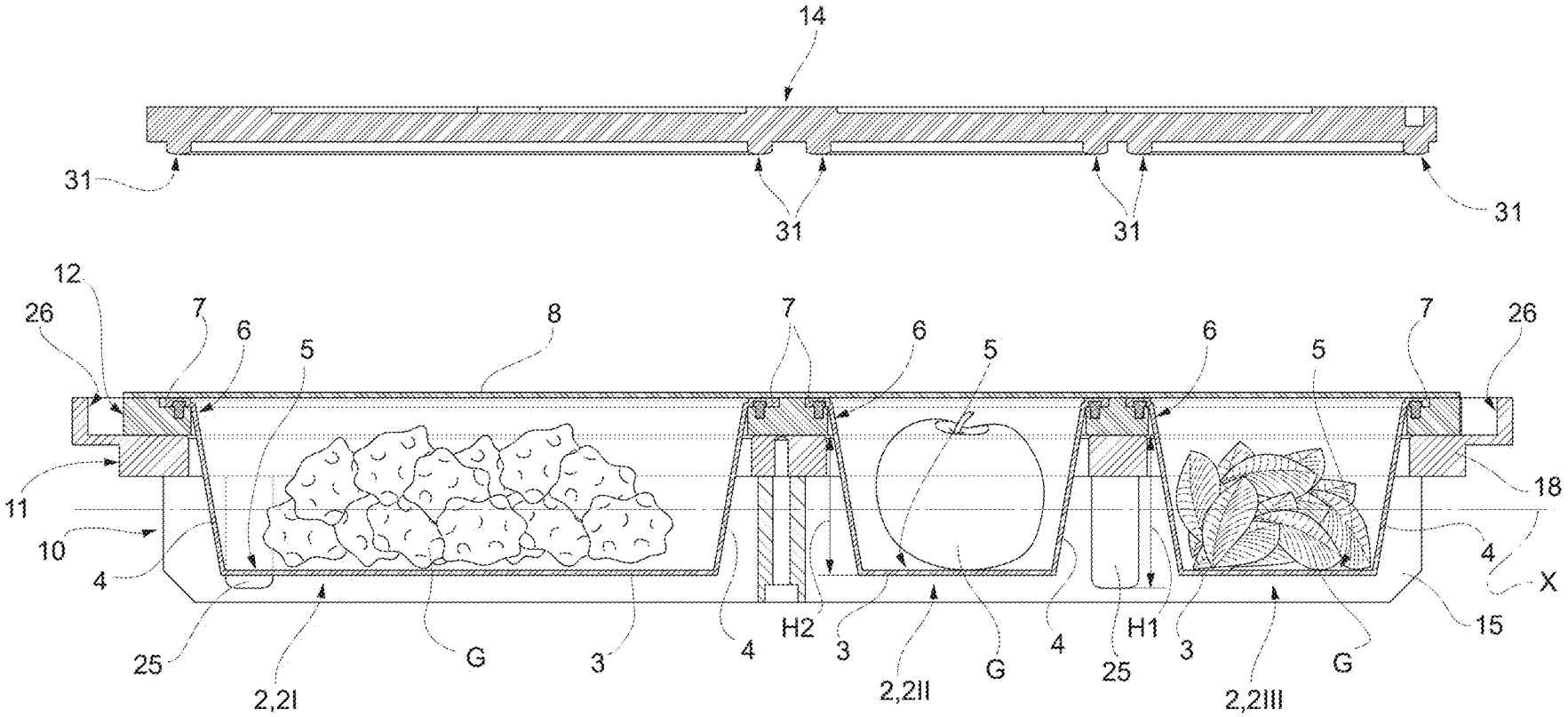
FIG. 7 shows, partially in section, the assembly group according to the present invention in an operational configuration.

Advantageously, base 10 and holder 11 are configured to provide structural strength to assembly group 9. In other words, base 10 and container nest holder 11 are configured to mechanically bear the pressures of a mould 14 during a thermal heating process (FIG. 7). Advantageously, as will be better explained hereinafter, container nest 12 is configured to come into contact with containers 2 and is shaped to position, while meal tray 1 is being manufactured, each container 2 in a predetermined position and orientation.

Base 10 is configured to give structural strength to assembly group 9. Base 10 is placed during the step of manufacturing meal tray 1 on the horizontal plane Π(FIG. 7). Base 10 is configured to keep containers 2 raised above the horizontal plane Π.

Figure 5:
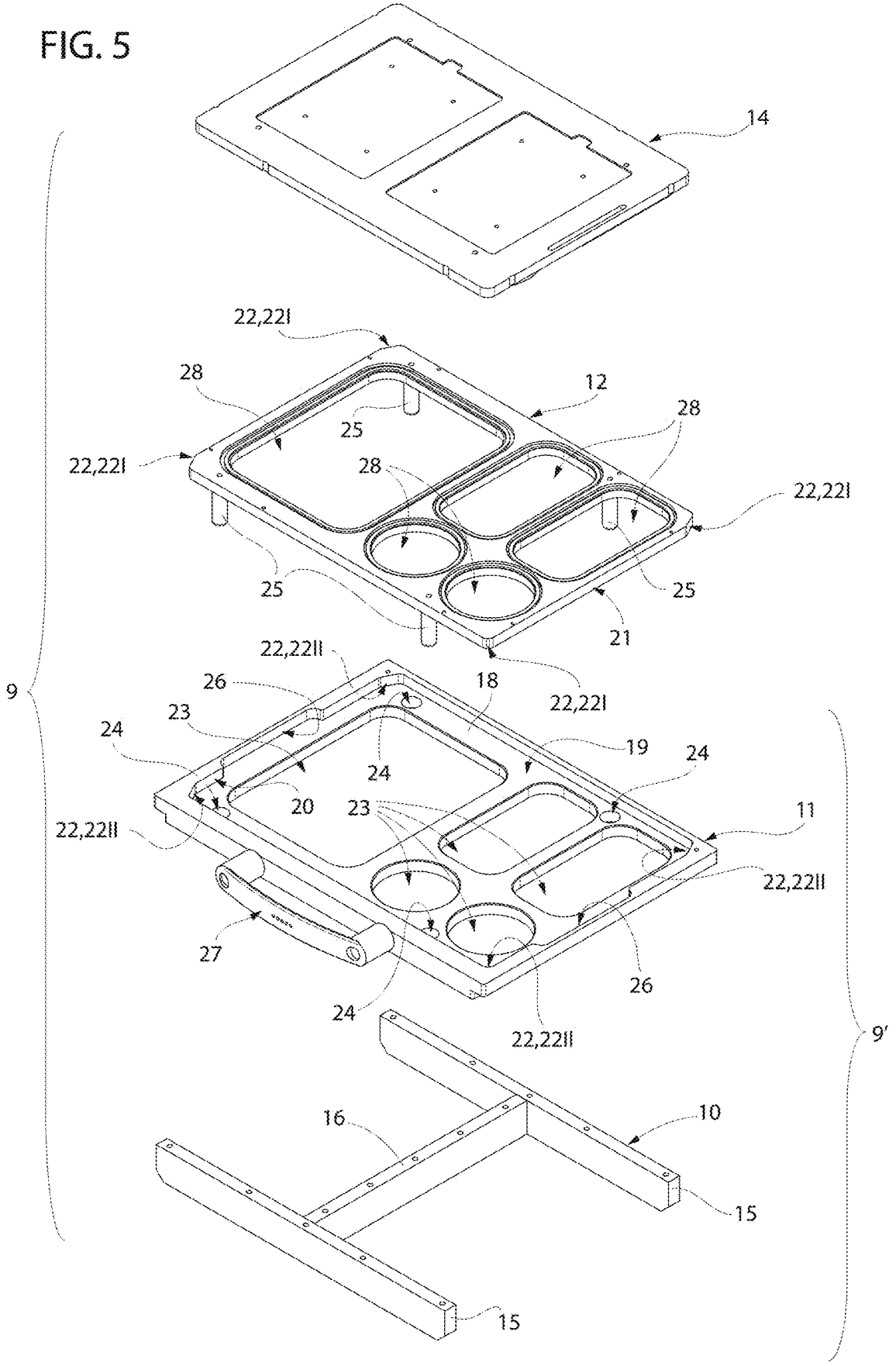
FIG. 5 is an exploded view of the assembly group of FIG. 4.

According to the example shown in FIG. 5, base 10 is substantially a frame having an H-shape and comprising two skids 15 parallel to each other along a longitudinal axis X and a crossbeam 16, which is transverse, in particular perpendicular, to the longitudinal axis X and connects skids 15 to each other. According to the example shown, skids 15 and crossbeam 16 are walls, in particular metal walls, having a thickness such as to form a coupling and/or interference fit with container nest holder 12. According to variants not shown, base 10 may have different shapes and sizes from those shown.

Container nest holder 11 comprises a plate 18 which is arranged, in use, to rest on base 10 and is substantially parallel to the support plane n. Plate 18 is made of mechanically resistant material, such as metal. Plate 18 has a recess 19 which is configured to house, at least partially, container nest 12. Recess 19 has a substantially coincident lateral profile 20 (slightly larger so as to allow a form fit with a clearance) with lateral profile 21 of container nest 12, so that, in use, container nest 12 can be inserted inside recess 19. Advantageously, the profile of recess 19 and container nest 12 have orientation elements 22 (interlocking geometric shapes, in the example shown these are chamfers made at zones that can be uniquely coupled to each other) that cooperate and allow for a unique possible orientation of container nest 12 with respect to recess 19 during insertion. Hereinafter and in the figures, the orientation elements of container nest 12 are identified with 221, whereas the orientation elements of recess 19 are identified with 22II.

Container nest holder 11 also has a plurality of openings 23, each opening 23 has such a shape and size as to house a respective container 2. The number, shape, size and distribution of openings 23 may differ from what is shown. Advantageously, container nest holder 11 has alignment holes 24 that are configured to couple, in use, with respective alignment pins 25 of container nest 12 (as will be further shown hereinafter). Advantageously, recess 19 has slots 26 that protrude outside respective portions of lateral profile 20. Each slot 26 is configured to allow container nest 12 to be gripped (mechanically or manually) during insertion and extraction steps. Advantageously, container nest holder 11 comprises gripping elements 27 that facilitate handling thereof. According to the example shown, gripping element 27 is a handle that is fixed at the side of plate 18, this solution is suitable for movements performed manually by an operator. According to a variant not shown, gripping elements 27 can be of different types and be suitable for mechanical actuation.

Container nest 12 is basically a laminar body made of a lightweight material, such as polymeric material. Container nest 12 has a plan shape that is substantially complementary (slightly smaller so as to allow a form fit with a clearance) to that of recess 19 of the respective container nest holder 11. Container nest 12 comprises a plurality of alignment pins 25, each of which is configured to be inserted inside a respective alignment hole 24 of container nest holder 11. Each alignment pin 25 has a vertical dimension H1 along a longitudinal axis Y perpendicular to plate 18. The vertical footprint H1 is greater than the thickness of plate 18 of container nest holder 11, so in use, alignment pins 25 protrude beneath container nest holder 11.

Advantageously, as shown in FIG. 7, the following relation is fulfilled:

$$H1 > H2$$

wherein,

H1 is the vertical dimension of each alignment pin 25;

H2max is the maximum vertical dimension of containers 2 that protrude, in use, beneath container nest holder 11, in particular beneath said plate 18.

Container nest 12 further has a plurality of openings 28 substantially coinciding in shape, number and size with openings 23 of container nest holder 11. Thus, in use, container nest 12 completely overlaps recess 19 of container nest holder 11.

Container nest 12 further has a gasket 29 arranged around (radially outside) each opening 28. The shape and size of each gasket 29 are a function of the perimeter of the respective opening 28. The depth of each gasket 29 substantially corresponds to the thickness of flange 7 of a respective container 2. Thus, in use, each container 2 can be inserted inside a respective opening 28 of container nest 12 by placing flange 7 against the respective gasket 29.

Figure 6:
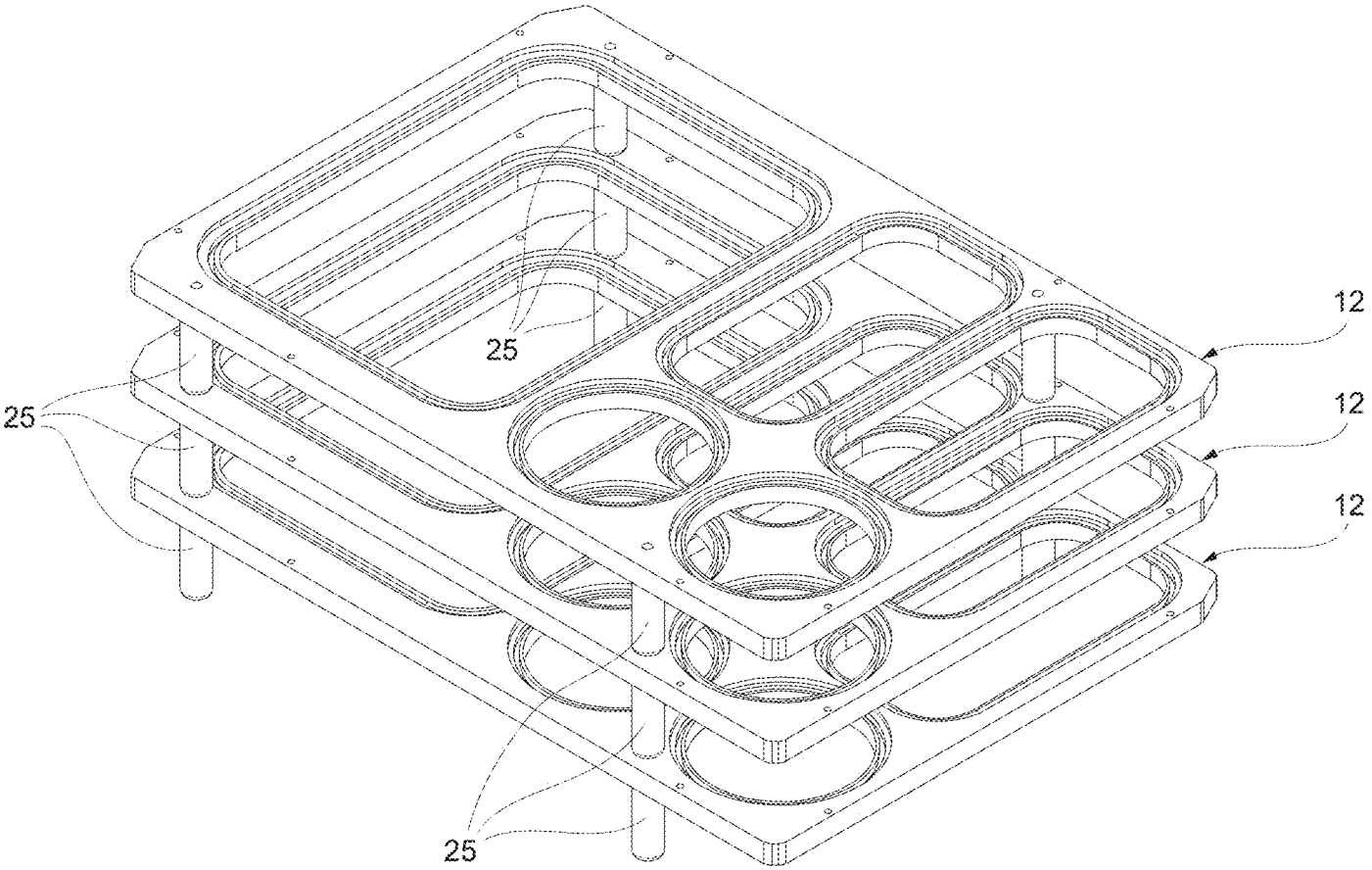
FIG. 6 shows a detail of the assembly group in a stacked configuration.

Container nest 12 further has centring holes 30, which face outwards. Each centring hole 30 is configured to be visible and accessible, in particular it is a mark for alignment, in use, with a respective reference pin 31 of mould 14, so as to allow, during a sealing step, the correct alignment of a thermoforming mould 14 with assembly group 9, as will be better shown hereinafter (FIG. 7). Furthermore, each centring hole 30 is configured as an interlocking element with a respective alignment pin 25, to allow the stacking of several container nests 12 on top of each other (FIG. 6).

The method of manufacturing a meal tray 1 according to the present invention is described hereinafter.

It should be noted that the hereinafter-reported sequence of the steps of the method has been chosen purely for descriptive purposes; in other words, the steps of the method according to the present invention may be performed in a different order than shown, moreover, two or more steps performed simultaneously.

The method comprises: a step of mounting an assembly group 9 for manufacturing a meal tray 1; a step of assembling meal tray 1; a step of filling meal tray 1; a step of sealing meal tray 1; a step of extracting meal tray 1.

Advantageously, the method further comprises: a step of disassembling assembly group 9, which in turn comprises a step of extracting container nests 12; a step of storing container nests 12; a step of sanitising container nests 12; and a step of handling container nests 12.

The step of mounting an assembly group 9 comprises the sub step of providing: a base 10, a container nest holder 11 and a container nest 12. The sub step of providing comprises choosing:

- a base 10 within a group of bases 10 differing from each other in shape and/or size;
- a container nest holder 11 within a group of container nest holders 11 differing from each other in shape and/or size;
- a container nest 12 within a group of container nests 12 differing from each other in shape and/or size.

The sub step of providing comprises selecting a base 10, a container nest holder 11, and a container nest 12 that are coordinated with each other so that they can be mounted together to form an assembly group 9. It should be noted that the choice of container nest holder 11 and/or container nest 12 may also vary depending on one or more of the following parameters relating to containers 2: number, shape, size and positioning. The shape of container nest 12 is a function of the type (varying in shape, size, number and position of containers 2) of meal tray 1 to be manufactured. Therefore, advantageously, the number, shape, size and position of the openings 28 of container nest 12 are variable.

Advantageously, providing an assembly group 9 comprising a plurality of components (a base 10, a container nest holder 11 and a container nest 12) that are distinct and can be coupled together, makes it possible to vary one or more components according to the type of meal tray 1 to be manufactured. This makes it advantageously possible to easily and flexibly vary the number, shape, size and position of containers 2 of meal tray 1 according to the user's needs.

The step of mounting an assembly group 9 comprises the steps of: coupling container nest holder 11 and base 10 to each other; and coupling container nest 12 to container nest holder 11 to each other (particularly at a sealing station).

During the step of coupling container nest holder 11 with base 10, base 10 is arranged on a horizontal support plane and container nest holder 11 is placed on base 10. Container nest holder 11 is fixed to base 10 in a releasable way, e.g. by means of form and/or interference fit elements. Advantageously, base 10 and container nest holder 11 coupled together form a base unit 9', which can bear mechanical and thermal stresses, such as stresses that develop during a thermal heating process. Advantageously, a work line may comprise a given number of base units 9' allocated to one or more sealing stations, particularly thermal heating stations. In other words, a base unit 9' remains positioned at a respective sealing station.

While entering a sealing station, a container nest 12, in particular already provided with filled containers 2 (the assembly and filling steps are explained in more detail below), is inserted into a base unit 9' and, in particular, is coupled with a container nest holder 11.

When coupling container nest 12 with container nest holder 11, container nest 12 is placed on container nest holder 11. Advantageously, container nest 12 is oriented so that orientation elements 221 are aligned with orientation elements 22II of recess 19. In addition, each alignment pin 25 of container nest 12 is aligned with a respective alignment hole 24 of container nest holder 11. This advantageously ensures the correct orientation of container nest 12 with respect to container nest holder 11 and base 10, thus preventing mistakes. Alignment pins 25 of container nest 12 protrude vertically beneath plate 18 and are configured to be contained, in use, in suspension within the volume of base 10. In other words, during use, alignment pins 25 do not come into contact with the support plane Π.

Advantageously, the removable polymeric container nest 12 is lightweight and easy to handle and move. In addition, the fact that container nest 12 is made of polymeric material makes it possible to avoid the production of noise when coupling it with container nest holder 11 (which would not happen if both of them were made of metal, for example, which would produce an annoying chattering noise during assembling/disassembling).

Advantageously, container nest holder 11 made of metal provides assembly group 9 with the necessary mechanical strength.

The step of assembling meal tray 1 comprises the sub step of inserting one or more containers 2 each within a respective opening 28 of container nest 12. Each container 2 is configured (e.g. in shape and size) to be inserted at least partially within the respective opening 28. During the sub step of inserting one or more containers 2, flange 7 of each container 2 is placed against sealing gasket 29 of the respective opening 28. Thus, once inserted into an opening 28, a container 2 remains suspended, i.e. is not in contact, with the support plane Π.

The filling step comprises: one or more sub steps of inserting products G into containers 2. The filling step comprises any sub steps of handling container nest 12 between one or more stations of a filling line.

The type and quantity of products G inserted within containers 2 is variable. Preferably, the products G are completely contained within the volume of the respective containers 2, so that they do not protrude out of them. Preferably, flange 7 of each container 2 remains free of product G. In other words, the product G of a container 2 does not overflow onto flange 7.

During the filling step, it is possible to insert products G intended to be heated or already hot into containers 2 housed in the hot zone H of tray 1 and cold products G into containers 2 housed in the cold zone C. During the filling step, it is possible to shield containers 2 of the hot zone H from containers 2 of the cold zone C. Advantageously, the function of thermally separating containers 2 of the hot zone H from containers 2 of the cold zone C is carried out by crossbeam 16 of base 10.

The sealing step comprises a sub step of applying a sealing element 8 above containers 2 inserted in container nest 12, which in turn is housed inside the container nest holder 11. Advantageously, sealing element 8 is a single body that closes all containers 2 so as to obtain a complete meal tray 1. The sealing step comprises the sub step of thermally heating sealing element 8 on gasket 29 of each container 2. During the thermal heating sub-step, a mould 14 is pressed against container nest 12 while pressing sealing element 8 onto gasket 29 of each container 2. The thermal heating sub step comprises the step of aligning mould 14 and container nest 12 with each other. This advantageously ensures the correct connection between flange 7 of each container 2 and closing element 8.

Once the sealing step is complete, tray 1 is extracted from container nest 12. In addition, container nest 12 is extracted from the respective base unit 9' and, in particular, decoupled from the respective container nest holder 11 (as will be better explained hereinafter).

Advantageously, the method described above has the advantage of achieving a single cohesive packaging (meal tray 1) that keeps a plurality of containers 2 gathered together. Furthermore, the method of the type described above, using the assembly group, allows to quickly change in a flexible manner the type of meal tray 1 manufactured. Thus, containers 2 of a meal tray 1 may differ from each other in shape and size and may contain hot or cold products G.

Figure 3:
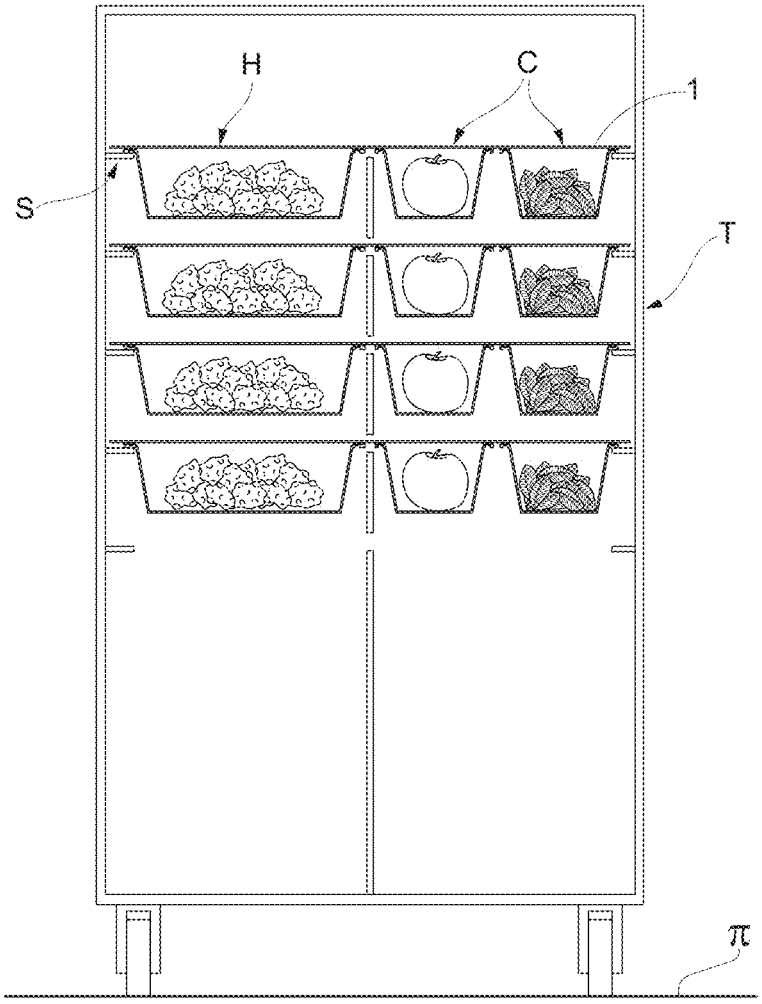
FIG. 3 schematically shows a meal tray during transport.

During the extraction step, meal tray 1 is lifted and moved away from container nests 12. Advantageously, the presence of slots 26 in meal tray holder 11 facilitates the grip of meal tray 1 itself. Once picked up, meal tray 1 may be stored and transported according to known methods. For example, it may be inserted within a special shelf S of a food trolley (FIG. 3). Advantageously, the food trolley T can have two separating columns to keep containers 2 containing hot products G thermally separated from containers 2 containing cold products G of a same tray.

The step of disassembling the assembly group 9 comprises the sub step of extracting container nest 12 from container nest holder 11. Advantageously, during the extraction sub step alignment pins 25 of container nest 12 protruding beneath container nest holder 11 are pushed upwards, either manually or automatically. Thus, decoupling is made easier. Advantageously, the fact that container nests 12 are made of lightweight material, such as polymeric material, facilitates disassembly and handling thereof. Advantageously, the fact of dividing base 10 and container nest holder 11, which act as mechanically resistant structures, from container nest 12, which is the element that comes into direct contact with containers 2 and, possibly, the product G inserted inside containers 2, makes it possible to minimise the sizes and weights of container nest 12 itself. This makes it possible to reduce the weight of the movable parts to be handled with obvious logistical advantages.

During the storage step, container nests 12 are stacked on top of each other. Alignment pins 25 of an upper container nest 12 are inserted within respective centring holes 30 of the lower container nest 12 in order to create a stable connection between container nests 12 of a stack. Alignment pins 25 have an extension such that container nests 12 are spaced from each other by a predetermined space such to allow gripping. The distance between container nests 12 of a stack also allows sanitising operations to be performed correctly.

During sanitising operations, container nests 12 can be treated, e.g. washed, either in a group stacked together or individually.

Advantageously, the fact that assembly group 9 comprises a removable container nest 12 makes it possible to easily sanitise each container nest 12 at the end of formation of the relevant meal tray 1. In other words, container nests 12 can be sanitised at the end of each production cycle of a meal tray 1 and, thus, the use of sanitised container nests 12 can be easily guaranteed at all times. This ensures complete hygiene of the entire process of manufacturing a meal tray 1.

Container nests 12 can be handled in stacks or individually.

Advantageously, the fact that the relationship H1> H2 is satisfied allows container nests 12 to be stacked on top of each other even with containers 2 already inserted within openings 28. Thus, stacks of container nests 12 can be handled quickly and easily with containers 2 already inserted.

Container nests 12 can be moved easily along the production line and can be fed either at the beginning of an entire production line or at a work station. Therefore, the step of mounting an assembly group 9 can take place either at the beginning of a production line or at a specific workstation.

Advantageously, container nest 12 of the type described above is a coordinated unit that moves in an orderly manner along the production line and allows all containers 2 to be handled together, thus facilitating the filling process at successive stations.

Advantageously, the method and assembly group 9 of the type described above allow to achieve in a flexible and simple way, a plurality of meal trays 1 differing from each other in number, shape, size and position of containers 2.

Assembly group 9 of the type described above: enables to automate the production of meal trays 1; ensures the necessary hygiene of the production line; guarantees the necessary mechanical resistance during the step of sealing meal tray 1. Moreover, advantageously, the method of the type described above makes it possible to use a higher number of container nests 12 than the number of bases 10 and container nests holders 11, so that the storage, sanitisation and handling operations of container nests 12 themselves and the insertion of containers 2 into container nests 12 can be performed in masked time.

The invention claimed is:

1. An assembly group for manufacturing a tray and comprising:

a base;

a container nest holder; and a container nest;

wherein the base, the container nest holder, and the container nest are coupled together in a releasable way; wherein, said container nest is configured to house a plurality of containers, wherein said container nest holder has a recess which is configured to house at least partially said container nest, wherein said container nest has a first orientation element and said container nest holder has a second orientation element which are configured to be aligned with each other to allow insertion of the container nest within the recess of said container nest holder.

2. The assembly group according to claim 1, wherein the container nest comprises one or more first openings configured to house the containers, and the container nest holder comprises one or more second openings configured to house the containers, each first opening overlapping at least partially a respective second opening.

3. The assembly group according to claim 1, wherein the base and the container nest holder are made of a material mechanically resistant to pressures generated during the heat-sealing operation.

4. The assembly group according to claim 1, wherein the base and the container nest holder are made of metal, and the container nest is made of a polymeric material.

5. The assembly group according to claim 1, wherein said container nest has one or more alignment pins and said container nest holder has respective alignment holes; wherein each alignment hole is configured to house, in use, a respective alignment pin.

6. The assembly group according to claim 1, wherein each alignment pin is configured to protrude, in use, beneath each container; wherein, for each alignment pin a following relationship is satisfied:

$$H1 > H2\text{max},$$

wherein, H1 is a vertical extension of each alignment pin; H2max is a maximum vertical extension of the containers which protrude, in use, below the container nest holder.

* * * * *